US007686573B2

(12) United States Patent
Clement

(10) Patent No.: US 7,686,573 B2
(45) Date of Patent: Mar. 30, 2010

(54) VERTICALLY-ORIENTED CENTRIFUGAL PUMP

(76) Inventor: Roger B. Clement, 2341 E. 1370 South, Spanish Fork, UT (US) 84660

( * ) Notice: Subject to any disclaimer, the term of this patent is extended or adjusted under 35 U.S.C. 154(b) by 629 days.

(21) Appl. No.: 11/561,258

(22) Filed: Nov. 17, 2006

(65) Prior Publication Data

US 2007/0110560 A1 May 17, 2007

Related U.S. Application Data

(60) Provisional application No. 60/737,794, filed on Nov. 17, 2005.

(51) Int. Cl.
*F04D 1/12* (2006.01)

(52) U.S. Cl. ..... 415/88; 415/89; 415/120

(58) Field of Classification Search ..... 415/901, 415/88, 89, 120, 143, 202, 916
See application file for complete search history.

(56) References Cited

U.S. PATENT DOCUMENTS 843,275 A * 2/1907 Huntley ..... 415/88
1,007,266 A * 10/1911 Burrell ..... 415/88
1,750,969 A * 3/1930 Schafran ..... 415/88
2,376,071 A * 5/1945 Miess ..... 415/88

* cited by examiner

*Primary Examiner*—Edward Look
*Assistant Examiner*—Dwayne J White
(74) *Attorney, Agent, or Firm*—Angus C. Fox, III

(57) ABSTRACT

An apparatus for elevating a fluid includes: a pumping member rotatable about a vertical axis, the pumping member having at least one ramped path, the ramped path having a lowermost portion insertable below the surface of a fluid to be elevated, and an uppermost portion that is more distant from the vertical axis than the lowermost portion thereof; a catch chamber surrounding a circular trajectory of the uppermost portion as it rotates about the vertical axis and positioned to receive fluid expelled from the uppermost portion; and a motor coupled to the pumping member for imparting rotational motion to the pumping member about the vertical axis, the motor having sufficient power to generate a centrifugal force that will drive the fluid from the lowermost portion of the ramped path to the uppermost portion and into the catch chamber.

11 Claims, 8 Drawing Sheets

VERTICALLY-ORIENTED CENTRIFUGAL PUMP

This application has a priority based on the filing of Provisional Patent Application No. 60/737,794 on Nov. 17, 2005.

BACKGROUND OF THE INVENTION

1. Field of the Invention

This invention relates to pumps and, more particularly, to centrifugal pumps capable of continuous elevation of massive flows of fluids to higher elevations.

2. Description of the Prior Art

In the realm of industrial equipment, pumps are indispensable. They are used to raise water from wells, move gases and fluids through pipelines, compress gases, create partial vacuums, pressurize fluids, and for countless other uses.

There are two basic kinds of pumps: mechanical and non-mechanical. Mechanical pumps, which are the most common type, rely on moving parts to generate the pumping action. Non-mechanical, on the other hand, move fluids by means of either electromagnetic force or the force of another fluid such as compressed air.

Most mechanical pumps are driven by a rotational power source, such as an electric motor, an internal combustion engine, a steam engine, a turbine engine, or a windmill.

Pumps are typically rated by the pressure that they can generate and the volume of fluid which they can deliver per unit of time. Certain types of pumps can deliver up to 2,650,000 liters (700,000 gallons) per minute, while other types of pumps can generate pressures up to 14,000 kg/cm$^2$ (200,000 lbs/in$^2$).

Many different types of mechanical pumps are available. Reciprocating pumps, which provide a discontinuous, or pulsating, supply of fluid, generally employ either a single-acting or double acting piston. The most common types of rotary pumps are gear pumps and sliding vane pumps. The former generally has a pair of meshed gears that are rotated inside an oblong chamber. Fluid is carried in spaces between the teeth of the gears and the walls of the chamber, thereby creating a partial vacuum at the inlet and drawing in addition fluid. Sliding vane pumps employ a rotor that is eccentrically mounted within a circular chamber so that it almost touches the chamber at a line parallel to the axis of rotation. Vanes, installed in slots evenly spaced about the circumference of the rotor, are generally pressed against the circular wall by centripetal force. As the rotor turns, fluid is carried in the cavities formed by the vanes and the wall of the chamber from one side of the chamber to the other. The off-center mounting of the rotor prevents backflow of fluid. Centrifugal pumps, which generally provide high rates of flow at moderate pressures, have an impeller with multiple curved blades mounted within a generally circular chamber having an axial intake and a rim outlet. As the impeller spins, the blades throw the fluid toward the rim, creating a partial vacuum near the impeller axle. Axial flow pumps have a bladed impeller mounted axially within a cylinder. As the impeller spins, the blades on the impeller cause fluid inside the cylinder to flow parallel to the impeller's axis of rotation. Mixed flow pumps combine the operating features of centrifugal and axial-flow pumps.

SUMMARY OF THE INVENTION

This invention includes four primary embodiments of a motor or engine driven centrifugal pump that rotates about a vertical axis. For several of the primary embodiments the pumping action is effected by purely centrifugal action. Certain enhancements may be added to these several primary embodiments to generate a siphon effect which assists in the pumping action. For one of the embodiments, pumping action is effected solely by a siphon effect created by centrifugal action.

The first primary embodiment includes a conical funnel rotating about its central vertical axis, through which is installed a drive shaft. At least one and, preferably, multiple, generally vertical ribs or partitions are affixed to the inner wall of the funnel. An electric motor or engine applies rotational torque to the drive shaft. As the funnel rotates, fluid enters the bottom of the funnel and begins to rotate. As it rotates, it climbs the inner wall of the funnel and is expelled at the top of the funnel. A first enhancement includes the addition of a generally cylindrical extension attached to the bottom of the conical funnel. The cylindrical extension reduces turbulence at the point of entry by gradually accelerating the rotation of the fluid until it reaches the conical portion. A second enhancement includes the addition of an inverted inner cone having it apex positioned at the center of the top of the cylindrical extension. The inverted cone is concentric with the conical funnel portion, but has a larger angle of revolution than the funnel portion, such that the area between the funnel and the cone exposed by a horizontal section taken through the cone at any elevation is generally the same as the area of a horizontal section taken through the cylindrical extension. A third enhancement includes the addition of a pair of generally horizontal flanges. One of the flanges is coupled to the top edge of the inverted inner cone; the other is coupled to the top edge of the funnel portion. For a preferred embodiment of the invention, the horizontal flanges converge toward one another as the distance from their center increases, thereby maintaining the constant area relationship of fluid flow. Centripetal force experienced by the fluid exiting in a generally horizontal direction exerts a siphoning effect on fluid climbing between the funnel and the cone, thereby enhancing pumping efficiency. A fourth enhancement includes the addition of generally vertically-oriented ribs within the cylindrical section, which angle toward the center of the cylindrical extension near the top thereof, thereby expelling fluid into the conical portion that is rotating at the same angular speed as the conical walls. For preferred embodiments of the invention, vertically oriented anti-vortex baffles are installed in the sump and prevent vortices from being created by the rotation of the pump.

The second primary embodiment utilizes principles similar to those employed by the first primary embodiment combined with the first four enhancements thereto, but with a very different structure. Two or more tubes are arranged in a rotationally balanced, vertically-diverging relationship. Although it is conceivable that a single tube could be used in combination with a counterbalance, the balance will vary as fluid climbs the single tube, thereby complicating any attempt at counterbalancing the single tube. The bottom ends of the tubes are preferably connected to a vertically-oriented cylindrical extension, and are also preferably shaped so that, together, they form a circular array, with each tube forming an equi-angular portion of the circle. The upper ends of the tubes are angled horizontally so that as the assembly of tubes rotates about a horizontal axis, all of them discharge fluid radially. The centripetal force experienced by fluid in the horizontal portion of a tube when the assembly spins exerts a siphoning effect on fluid climbing the angled portion of the tube. Alternatively, each of the tubes can terminate without a horizontal extension, thereby eliminating any siphoning effect. A first enhancement to the second primary embodiment is identical to the fifth enhancement of the first primary embodiment of the invention, and includes the addition of generally vertically-oriented ribs within the cylindrical section, which angle toward the center of the cylindrical extension near the top thereof, thereby expelling fluid into the rotating tubes that is rotating at the same angular velocity as the tubes. A second enhancement to the second primary embodiment includes the addition of right-angled terminations at the ends of the horizontal extensions. The terminations are angles opposite the direction of pump rotation so that the pump benefits from the opposite and equal reaction of fluid expelled therefrom. This jet effect recovers some of the energy used to rotate the pump.

The third primary embodiment, which relies entirely on siphoning action to raise the fluid, has a central vertical tube open at the bottom end thereof. The central vertical tube is capped with two or more balanced horizontal tubes which radiate from the axis of the central vertical tube and terminate in a vertical right angle turn. Alternatively, the horizontal tubes may be replaced with tubes that are ramped to a height of at least about the diameter thereof. The assembly rotates about the vertical axis of the central vertical tube. Fluid being forced through the horizontal tubes as the assembly spins draws fluid up the central vertical tube. The third primary embodiment pump must be primed in order to begin the pumping action. This may be accomplished either with a one-way valve near the base of the central vertical tube or with sealing caps on the tops of the right angle turns which are either spring-loaded or gravity actuated to a normally-closed position.

The fourth primary embodiment most easily utilizes the funnel structure of the first primary embodiment. However, instead of having a central axis drive shaft, the funnel structure is equipped with a pair of annular support flanges, which are laterally and vertically supported by rollers, thereby permitting the funnel structure to operated by a belt or gear drive.

Any of the four primary embodiments may be equipped with an turbine which is able to recover some of the energy in contained by the radially expelled fluid. The turbine encircles the pump outlet, and is installed concentric with the pump rotational axis, so that the expelled fluid impacts the turbine blades.

The second primary embodiment of the centrifugal pump may be equipped with turbines at the exit end of each of the horizontal outlet tubes. Each of the turbines is spaced from the exit end so that it does not consume power provided by the pump motor, but merely recovers kinetic energy from the expelled fluid.

In addition, a turbine may be installed where fluid flows into the sump from a greater elevation with recoverable kinetic energy.

In order to prevent fluid that is expelled at the top of the pump from spinning in the collection chamber, baffle plates may be installed about the inner periphery of the collection chamber.

DETAILED DESCRIPTION OF THE INVENTION

The various embodiments of the new centrifugal pump will now be described in detail, with reference to the attached drawing FIGS. 1 through 13. It should be understood that the drawings of the various embodiments of the invention are intended to be merely illustrative of the invention. It should not be assumed that they are either drawn to scale or that they are engineering drawings.

Figure 1:
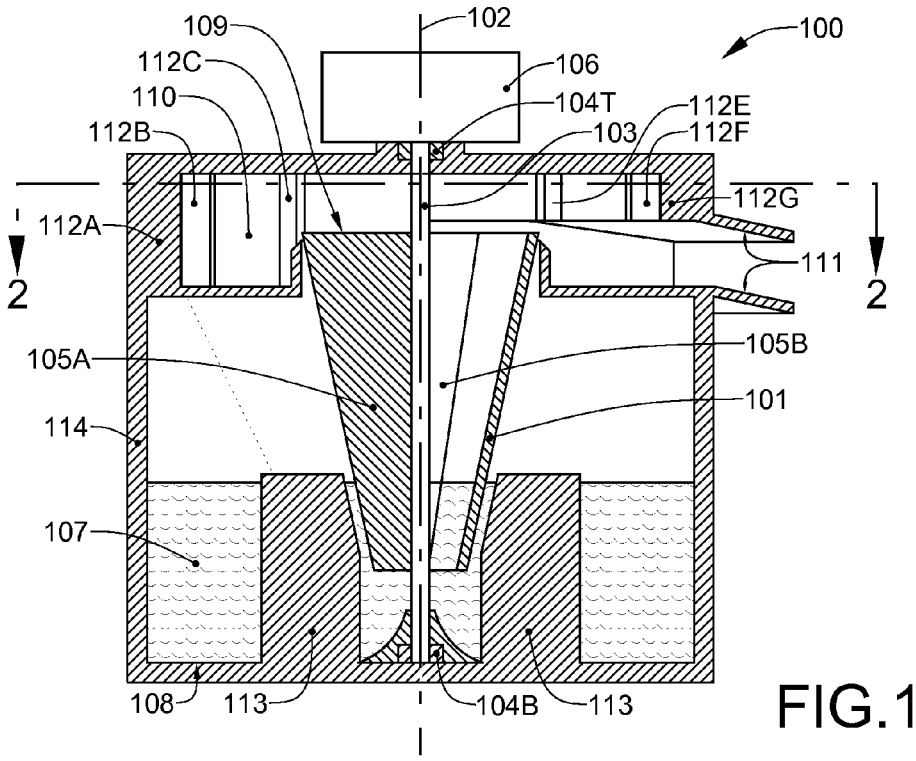
FIG. 1 is cross-sectional elevational view of a first primary embodiment of the new centrifugal pump.
Figure 2:
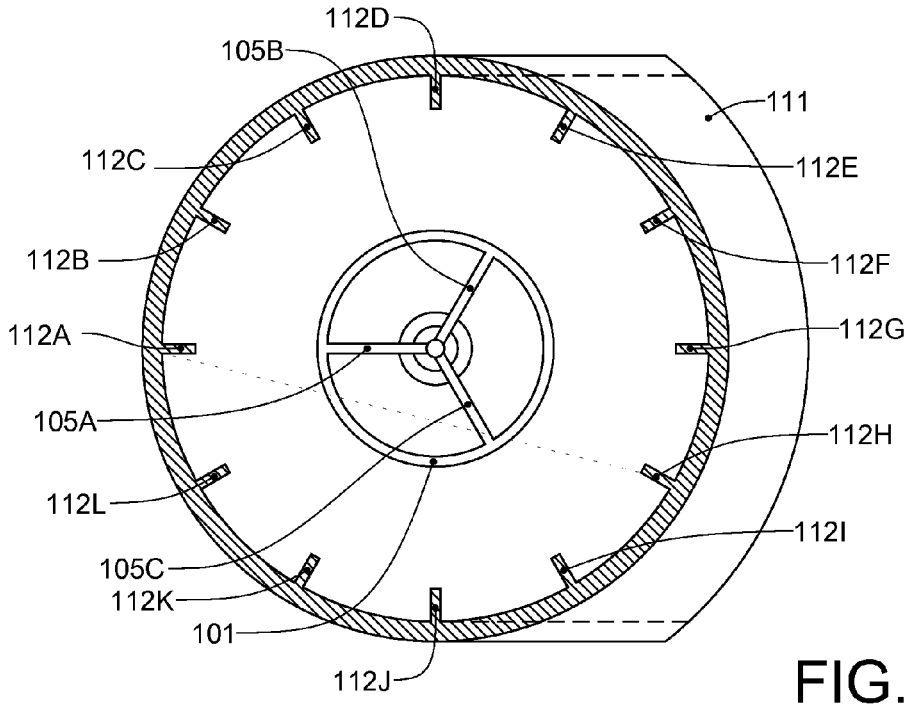
FIG. 2 is a cross-sectional top plan view of the first primary embodiment pump of FIG. 1, taken through section line 2-2.

Referring now to FIGS. 1 and 2, a first primary embodiment 100 of the new centrifugal pump includes a truncated right conical member (also known as a funnel) 101 rotating about its central vertical axis 102, through which is installed a drive shaft 103. At least one and, preferably, multiple, generally vertical partitions 105A, 105B and 105C are affixed to the inner wall of the funnel. An electric motor 106 or engine applies rotational torque to the drive shaft 103. As the funnel 101 rotates, fluid 107 residing in the sump 108 enters the bottom of the funnel and begins to rotate. As it rotates, it climbs the inner wall of the funnel 101 and is expelled at the top 109 of the funnel 101 into a catch chamber 110, from whence it exits through a discharge chute 111. A circular array of baffle plates 112A-112L may be positioned around the catch chamber 110 to prevent expelled fluid from spinning therein. In addition, a plurality of anti-vortex baffles 113 are positioned within the sump 108 to prevent vortices from being created by the rotation of the pump. The pump frame 114 interconnects the various non-rotating parts of the pump, incuding the top bearing 104T and the bottom bearing 104B that support the ends of the drive shaft 103.

Figure 3:
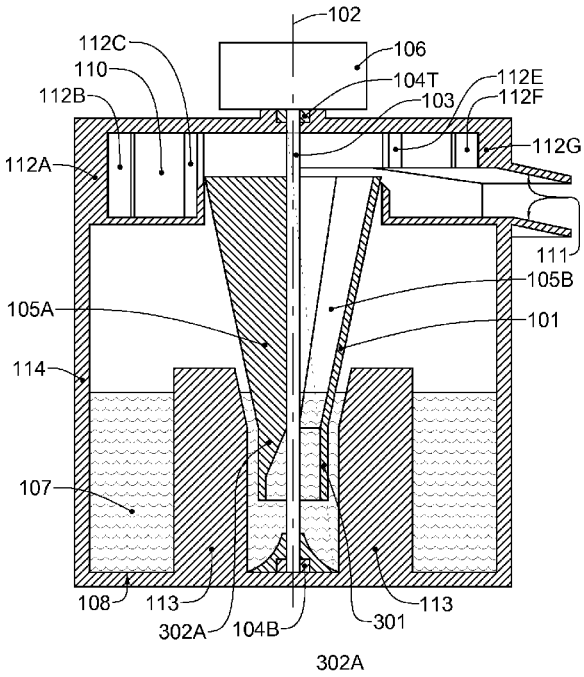
FIG. 3 is a cross-sectional elevational view of an enhanced first primary embodiment centrifugal pump having a lower cylindrical extension equipped with partitions.

Referring now to FIG. 3, a first enhancement to this design includes the addition of a generally cylindrical extension 301 attached to the bottom of the conical funnel 101. The cylindrical extension 301 reduces turbulence at the point of entry by gradually accelerating the rotation of the fluid 107 until it reaches the conical funnel portion 101. Also seen within the cylindrical extension 301 is a partition extension 302A that is coextensive with the vertical partition 105A. Each of the other vertical partitions 105B and 105C has a partition extension 302B and 302C (not shown), respectively. These partition extensions 302A-302C gradually accelerate rotation of the fluid as it enters the cylindrical extension 301 so that it is rotating at the same rate as the funnel portion 101 as it begins to enter the latter.

Figure 4:
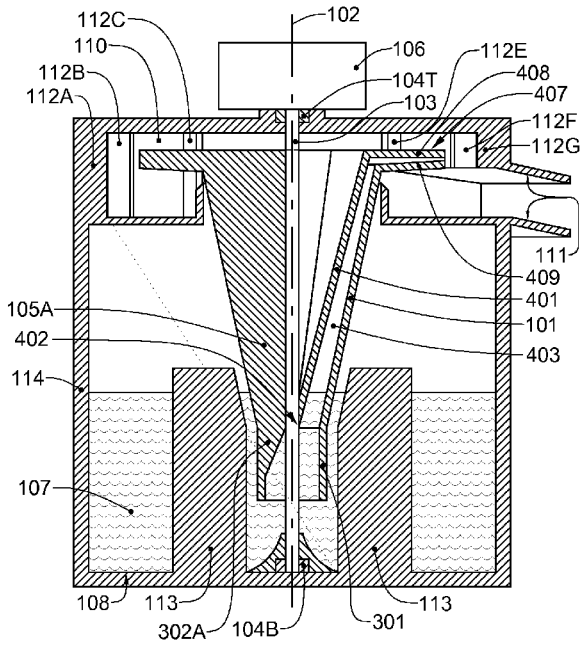
FIG. 4 is a cross-sectional elevational view of an enhanced first primary embodiment centrifugal pump having a coaxial inner cone and converging, but nearly horizontal exit flanges.

Referring now to FIG. 4, a second enhancement to the first primary embodiment design includes the addition of an inverted inner cone 401 having it apex 402 positioned at the center 403 of the top of the cylindrical extension 301. The inverted cone 401 is coaxial with the conical funnel portion 101, but preferably has a larger apex angle than the interior angle of the funnel portion 101, such that the area between the funnel 101 and the inverted cone 401 exposed by a horizontal section taken through the rotating assembly 406 at any elevation is generally constant and the same as the area of a horizontal section taken through the cylindrical extension 301. In other words, the angles of the funnel 101 and the inverted cone 401 are selected so that the upward velocity of fluid flow remains constant. Because of the constant area relationship, this design utilizes siphoning action to help raise the fluid. Although not a preferred embodiment of the invention, the wall of the inverted cone 301 and that of the funnel 101 may be parallel. In such a case, siphoning action would be absent, as cavitation would occur as air mixed with the liquid as in the funnel.

Still referring now to FIG. 4, a third enhancement to the first primary embodiment design includes the addition of a generally horizontal annular outlet 407 at the top of the assembly, which ducts the fluid passing between the funnel 101 and the inverted cone 401 in a radially outward direction. The annular outlet 407 includes a first annular flange 408 that is sealably coupled to an upper circumferential edge of the inverted cone 401, and a second annular flange that is sealably coupled to an upper circumferential edge of the concial funnel portion 101. In order to take advantage of siphoning action, the annular outlet becomes restricted as its distance from the center axis increases, thereby creating an generally horizontal discharge path that maintains the constant area relationship of fluid flow. The centripetal force experienced by the exiting fluid exerts a siphoning effect on fluid climbing between the funnel and the cone, thereby enhancing pumping efficiency.

Figure 5:
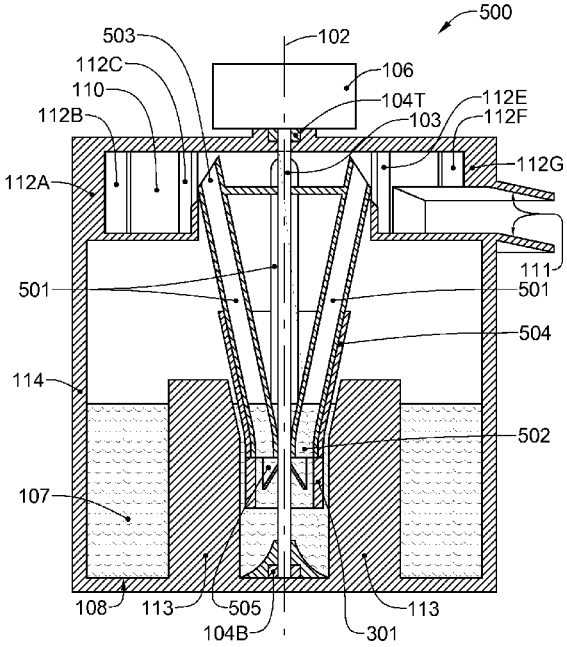
FIG. 5 is a cross-sectional elevational view of a second primary embodiment of the new centrifugal pump.

Referring now to FIG. 5, a second primary embodiment 500 of the new centrifugal pump utilizes principles similar to those employed by the first primary embodiment 100, combined with the first three enhancements thereto, but with a very different structure. Two or more tubes 501 are arranged in a rotationally balanced, vertically-diverging relationship. The bottom ends 502 of the tubes 501 are connected to a vertically-oriented cylindrical extension 301, and are preferably shaped so that, together, they form a circular array, and each tube forms an equi-angular portion of the circle. For example, for a four-tube configuration, the bottom of each tube 502 has a generally quarter-pie shape with a notch for the drive shaft 103 at the center. For the embodiment shown in this drawing figure, the upper ends 503 of the tubes 501 terminate just above the catch chamber 110. A conical sheath 504 wraps at least a bottom portion of the tubes 501 in order to minimize turbulence as the pump rotates about the vertical axis 102. A second enhancement to the second primary embodiment is very similar to the enhance first primary embodiment of FIG. 3, with respect to the addition of the partition extensions 302A-302C. In this case, angled partitions 505 are placed between the openings of each pair of diverging tubes 501. As the assembly of tubes 501 rotates about the axis 102, centrifugal action lifts the fluid 107 up through each of the tubes 501 to the catch chamber 110 from whence it is discharged through the discharge chute 111.

Figure 6:
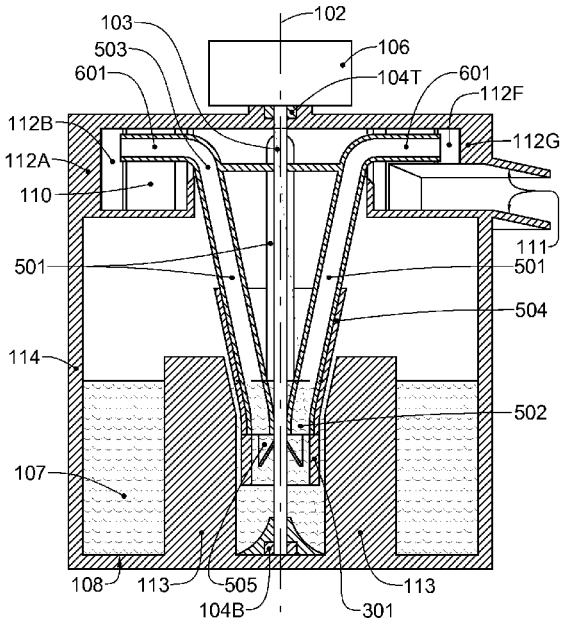
FIG. 6 is a cross-sectional elevational view of an enhanced second primary embodiment centrifugal pump having horizontal extensions attached to the upper ends of the diverging tubes.

Referring now to FIG. 6, a first enhancement to the second primary embodiment is the addition of horizontally angled extensions 601 to the tops of the diverging tubes 501, so that as the assembly of tubes is rotated about its horizontal axis 602 by the pump motor 105, all of them discharge fluid 106 radially. The centripetal force experienced by fluid 106 in the horizontal portion of a tube when the assembly spins exerts a siphoning effect on fluid that is climbing the vertically diverging tubes 501. These angled partions 505 gradually accelerate rotation of the fluid as it enters the cylindrical extension 301 so that it is rotating at the same angular velocity as the diverging tubes when it enters them.

Figure 7:
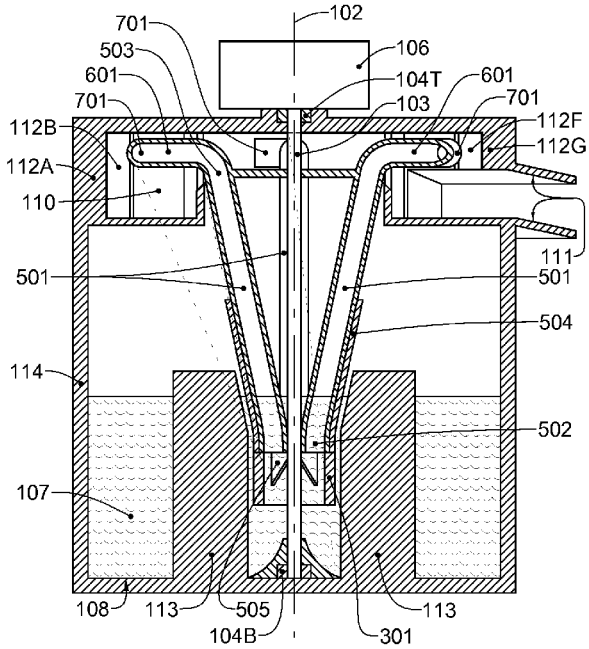
FIG. 7 is a cross-sectional elevational view of an enhanced second primary embodiment centrifugal pump having a right angle termination on each of the horizontal extensions.

Referring now to FIG. 7, a third enhancement to the second primary embodiment is the addition of right-angled terminations 701 to the open ends of the horizontal extensions 601 of FIG. 6. The right-angled terminations 701 are angled opposite the direction of pump rotation so that the pump benefits from the opposite and equal reaction of fluid expelled therefrom. This jet effect recovers some of the energy used to rotate the pump.

Figure 8:
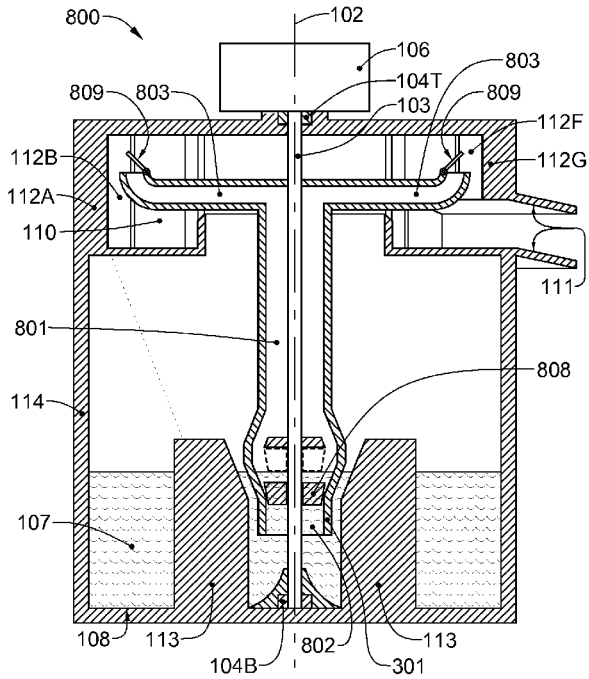
FIG. 8 is an elevational view of a third primary embodiment of the new centrifugal pump which has a single vertical center tube with multiple balanced generally horizontal tubes coupled to the top of the center tube.

Referring now to FIG. 8, a third primary embodiment 800 of the new centrifugal pump, which relies entirely on siphoning action to raise the fluid, has a central vertical tube 801 open at a bottom end 802 thereof. The central vertical tube is capped with two or more rotationally balanced horizontal tubes 803, which radiate from the axis of the central vertical tube 801. Each horizontal tube terminates in a 90-degree elbow 804 that is upwardly angled. Alternatively, the horizontal tubes 803 may be replaced with ramped tubes (not shown), that are ramped at least about the diameter thereof. The assembly comprising the vertical tube 801, the horizontal tubes 803 and the 90-degree elbows 804 rotates about the vertical central axis 102 of the vertical tube 801. Fluid 107 being expelled through the horizontal tubes 803 as the assembly spins draws fluid up the central vertical tube 801. This third primary embodiment pump 800 must be primed in order for the pumping action to begin. This may be accomplished either with a one-way valve 808 at the base of the central vertical tube 801 or with spring-loaded, fluid-tight caps 809 on the tops of the right angle elbow 804 or at the end of each ramped tube, or both. With the one-way valve 808 and caps 809 in place, the central vertical tube 801 and the horizontal tubes 803 or ramped tubes may be filled with fluid before beginning rotation of the pump with the motor 810.

Figure 9:
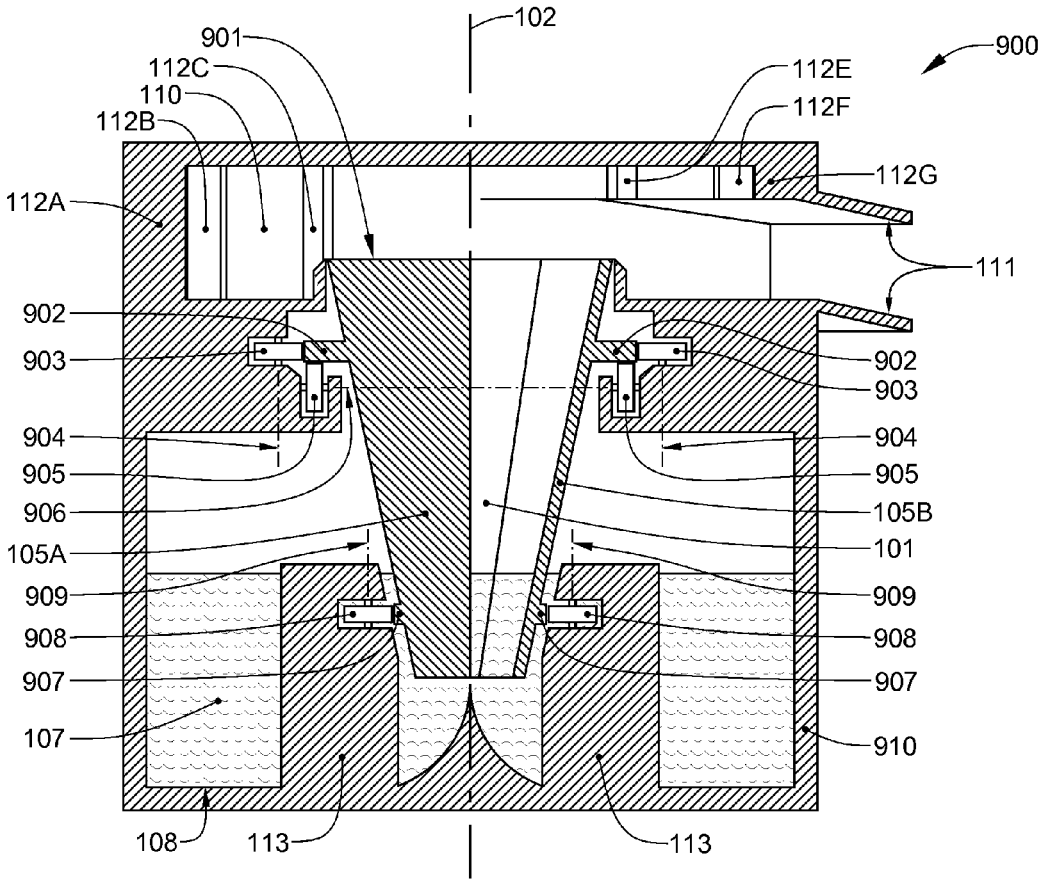
FIG. 9 is an elevational view of a fourth primary embodiment of the new centrifugal pump.

Referring now to FIG. 9, a fourth primary embodiment 900 of the new centrifugal pump is most easily adapted to use the funnel structure of the first primary embodiment 100. This particular embodiment is most like the funnel structure of FIG. 4. However, instead of having a central axis drive shaft 103, the funnel structure 901 of the fourth embodiment 900 is equipped with an upper support flange 902 that is maintained in axial alignment by a first set of at least three, equiangularly-spaced rollers 903, each of which is rotatable about a verical axis 904, and vertically supported by a second set of at least three, equiangularly-spaced rollers 905, each of which is rotatable about a horizontal axis 906. The funnel structure 901 is also equpped with a lower support flange 907 that is maintained in axial alignment by a third set of at least three, equiangularly-spaced rollers 908, each of which is rotatable about a vertical axis 909. This support arrangement permits the funnel structure 901 to be rotated by a belt or gear drive acting on the upper circumferential rim 906 of the funnel structure 901 or by driving the second set of rollers 905. The various frame elements are tied together as a unit 910.

Figure 10:
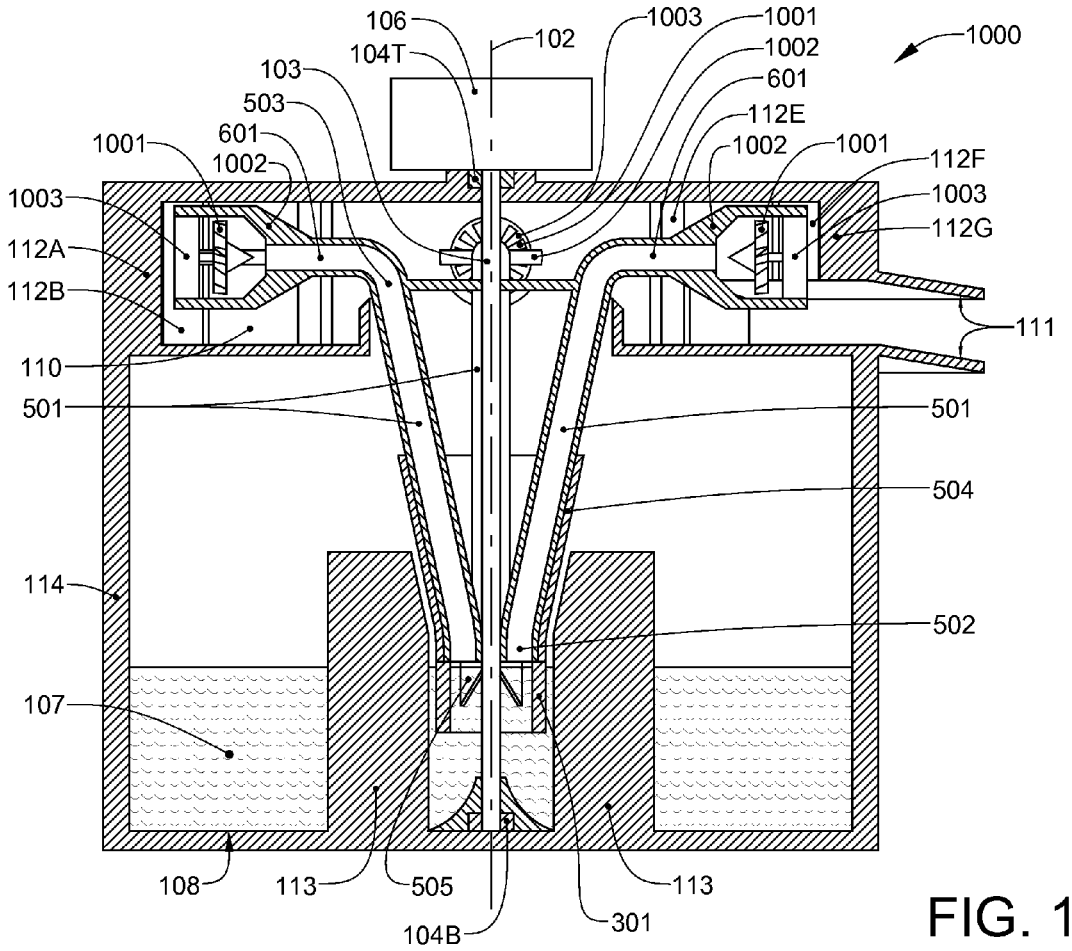
FIG. 10 is an elevational view a second primary embodiment centrifugal pump which has been fitted with power-generating turbines at the end of each exit tube.

Referring now to FIG. 10, the enhanced second primary embodiment centrifugal pump of FIG. 6 is shown equipped with a power generating turbine 1001 coupled to the discharge outlet of each of the horizontal extensions 601 of the tubes 501. Each of the turbines 1001 is spaced from the horizontal extensions 601 so that it does not require the expenditure of additional power by the pump motor 106, but merely recovers kinetic energy from the expelled fluid 107. Each of the turbines 1001 is coupled to an electrical generator 1003. The term "generator" is intended to include both generators and alternators. A bracket assembly 1002 secures the generator 1003 to the outer end of each horizontal extension 601.

Figure 11:
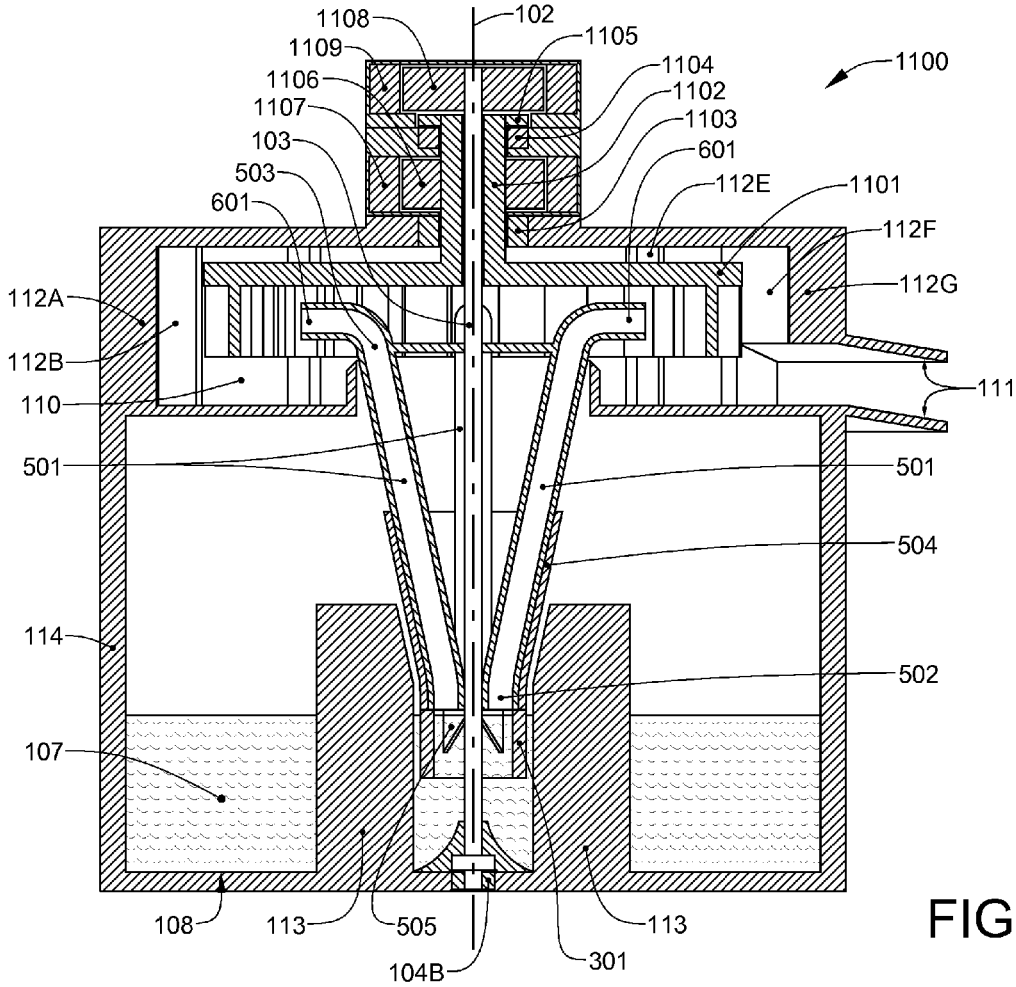
FIG. 11 is an elevational view of an enhanced second primary embodiment pump which has been equipped with a power-generating turbine around the inner periphery of the pump discharge chamber.

Referring now to FIG. 11, any of the four primary embodiments may be equipped with an turbine wheel 1101 which is able to recover some of the energy in contained by the radially expelled fluid. The turbine 1101 encircles the rotatable pumping member, which may be the truncated conical member 101 such as that shown in FIG. 1, the vertically diverging tubes 501 of FIGS. 5, 6, 7 or 11, the combination of a truncated right conical member and an inverted conical member as shown in FIG. 4, or the combination of multiple horizontal upper tubes coupled to a single vertical tube as shown in FIG. 8. The turbine 1101 is installed concentric with the pump rotational axis 102 so that the expelled fluid 107 impacts the blades of the turbine 1101. Power takeoff is via a turbine output shaft 1102 that is concentric with the drive shaft 103. The turbine output shaft 1102, which rides within bearings 1103 and 1104, is rigidly coupled to a generator rotor or armature 106. A generator stator 107 surrounds the armature 106. An collar 1105 is secured to the turbine output shaft 1102 and rides against the top surface of bearing 1104. The drive shaft 103 is rigidly coupled to a motor armature 1108, which rotates within a motor stator 1109.

Figure 12:
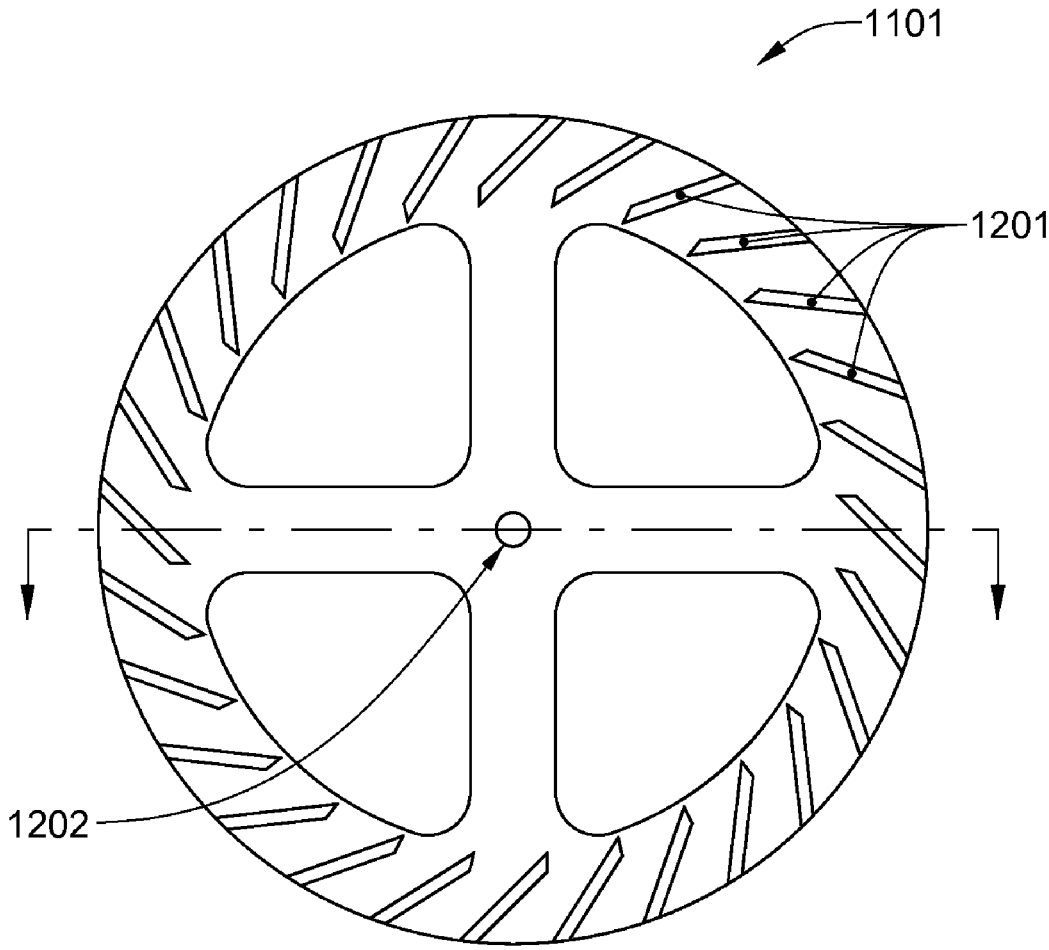
FIG. 12 is a bottom plan view of the turbine wheel of the apparatus of FIG. 11.

Referring now to FIG. 12, a bottom view of the turbine 1101 shows the 28 turbine blades 1201 which are rigidly affixed thereto.

It will be noted that each of the principal embodiments 100, 500 and 800 of the new centrifugal pump incorporates anti-vortex partitions 113 around the periphery of the intake. Without the partitions, the spinning of the pump will create a vortex that lessens the efficiency of the pump by making it difficult for fluid to enter the intake.

Although only several embodiments of the invention have been shown and described, it will be obvious to those having ordinary skill in the art that changes and modifications may be made thereto without departing from the scope and the spirit of the invention as hereinafter claimed.

What is claimed is:

1. A pump for continuously elevating a fluid from a first level to a second level, said pump comprising:

a sump for holding fluid to be elevated, said sump having a minimum operating water level;

a pumping member rotatable about a vertical axis, said pumping member having at least one ramped path for fluid, said ramped path extending from a lower level to an upper level, said lower level being below said minimum operating water level, an uppermost portion of said ramped path being more distant from the vertical axis than a lowermost portion thereof, wherein said at least one ramped path includes an inner surface of a truncated first conical member and an outer surface of a non-truncated second conical member, said first and second conical members being coaxial, said second member being positioned within said first conical member, and wherein an apex angle of said second conical member is greater than that of said first conical member; and a motor coupled to said pumping member for imparting rotational motion to said pumping member about said vertical axis, said motor having sufficient power to generate a centrifugal force that will drive the fluid from the lowermost portion of the ramped path to the uppermost portion and into the catch chamber.

2. The pump of claim 1, which further comprises a catch chamber surrounding a circular trajectory of said uppermost portion as it rotates about the vertical axis, said catch chamber being positioned to receive fluid expelled from said uppermost portion.

3. The pump of claim 1, wherein apex angles of said first and second conical members are selected such that an area between said first and second conical members exposed by a horizontal section taken through said rotating pumping member at any elevation is generally constant.

4. The pump of claim 1, which further comprises a pair of generally horizontal first and second annular flanges, said first annular flange being sealably coupled to an upper circumferential edge of said first conical member, and said second flange being sealably coupled to an upper circumferential edge of said second conical member.

5. The pump of claim 4, wherein a spacing between outer edges of said first and second annular flanges is less than a spacing between inner edges thereof, in order to increase siphoning action on fluid climbing the ramped path.

6. The pump of claim 1, which further comprises a cylindrical extension sealably coupled to said lowermost portion of said ramped path, said cylindrical extension being coaxial with said vertical axis.

7. The pump of claim 1, wherein said pumping member is supported on a rotatable shaft that is coaxial with said vertical axis.

8. The pump of claim 1, wherein said pump further comprises:

upper and lower flanges integral with said pumping member;

a first set of at least three, generally equiangularly spaced rollers which provide vertical support for said upper flange;

a second set of at least three, generally equiangularly spaced rollers which operate against an outer rim of said upper flange to provide alignment of said upper flange about said vertical axis; and a third set of at least three, generally equiangularly spaced rollers which operate against an outer rim of said lower flange to provide alignment of said lower flange about said vertical axis.

9. An apparatus for continuously transporting a fluid from a first level to a second level, said apparatus comprising:

a pumping member rotatable about a vertical axis, said pumping member having at least one ramped path for fluid, said ramped path having a lowermost portion insertable below the surface of a quantity of water to be elevated, and an uppermost portion that is more distant from the vertical axis than said lowermost portion thereof, wherein said at least one ramped path includes an inner surface of a truncated first conical member and an outer surface of a non-truncated second conical member, said first and second conical members being coaxial, said second member being positioned within said first conical member, and wherein an apex angle of said second conical member is greater than that of said first conical member;

a catch chamber surrounding a circular trajectory of said uppermost portion as it rotates about the vertical axis, said catch chamber being positioned to receive fluid expelled from said uppermost portion; and a motor coupled to said pumping member for imparting rotational motion to said pumping member about said vertical axis, said motor having sufficient power to generate a centrifugal force that will drive the fluid from the lowermost portion of the ramped path to the uppermost portion and into the catch chamber.

10. The pump of claim 9, wherein apex angles of said first and second conical members are selected such that an area between said first and second conical members exposed by a horizontal section taken through said rotating pumping member at any elevation is generally constant.

11. The pump of claim 9, which further comprises a cylindrical extension sealably coupled to said lowermost portion of said ramped path, said cylindrical extension being coaxial with said vertical axis.

* * * * *